US006806837B1

(12) United States Patent
Saucier et al.

(10) Patent No.: US 6,806,837 B1
(45) Date of Patent: Oct. 19, 2004

(54) DEEP DEPRESSION ANGLE CALIBRATION OF AIRBORNE DIRECTION FINDING ARRAYS

(75) Inventors: Norman E. Saucier, New Ipswich, NH (US); Norman D. Paul, Brookline, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 55 days.

(21) Appl. No.: 10/215,596

(22) Filed: Aug. 9, 2002

(51) Int. Cl.[7] ..... H01Q 1/28
(52) U.S. Cl. ..... 343/705; 342/169; 342/170
(58) Field of Search ..... 343/705, 708, 343/853, 169, 170, 171, 172, 173

(56) References Cited

U.S. PATENT DOCUMENTS

| | | | | |
|---|---|---|---|---|
| 3,129,422 A | * | 4/1964 | Fox | 342/59 |
| 3,153,784 A | * | 10/1964 | Petrides et al. | 342/52 |
| 4,359,732 A | * | 11/1982 | Martin | 342/191 |
| 5,039,991 A | * | 8/1991 | Boese et al. | 342/420 |
| 5,184,137 A | * | 2/1993 | Pozgay | 342/174 |

* cited by examiner

*Primary Examiner*—Tho Phan

(74) *Attorney, Agent, or Firm*—Robert K. Tendler; Daniel J. Long

(57) ABSTRACT

A system for calibrating airborne direction finding antenna arrays eliminates the problem of trying to maintain a constant depression angle when flying an airplane directly over a calibration antenna to collect deep depression angle data. The deep depression angle data necessary for calibration is provided by data from a scale model of the aircraft having a direction-finding array which simulates the actual direction-finding array on the aircraft. In order to collect deep depression angle data, the model is pivoted through 360° while maintaining a controlled depression angle. Thus, it is unnecessary for calibration to actually fly a plane to attempt to obtain deep depression angle measurements. In the subject system, only a single depression set of data is required from the aircraft. Thus, with the exception of baseline shallow depression angle data from this plane, the calibration data comes strictly from the scale model, which is much more easily obtained. Optimization techniques are used in which a set of data is collected from the airplane at one shallow depression angle which is used with the data collected from the scale model at the same shallow depression angle to derive a complex set of optimized weights that are then applied to the data collected from the model at the remainder of the depression angles to obtain the appropriate database for use on this aircraft for direction finding. In so doing, the aircraft need only be flown to establish data at a relatively shallow depression angle which can be easily collected by an aircraft flying in circles or banana pattern at some distance from the calibration antenna.

5 Claims, 5 Drawing Sheets

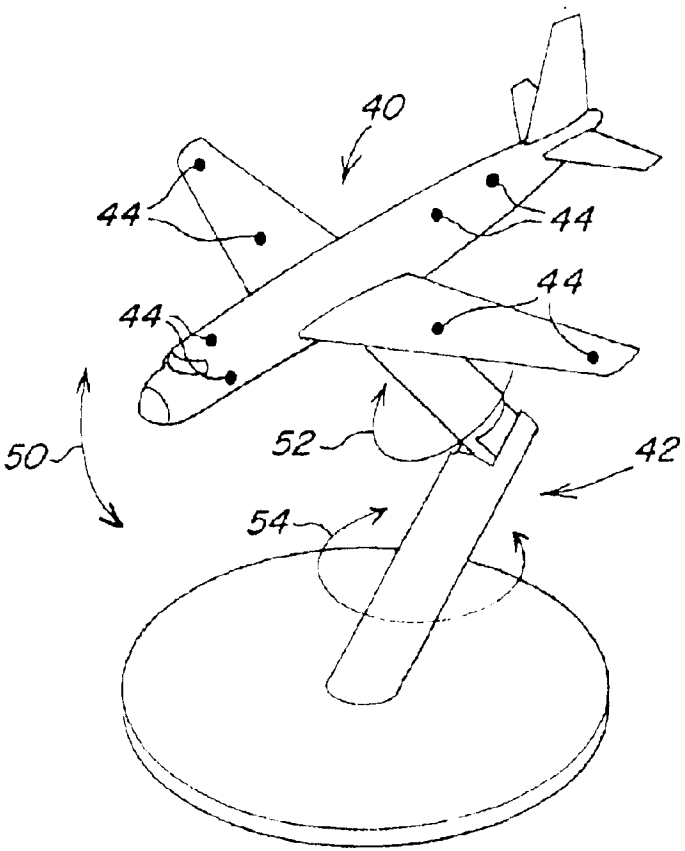
FIG. 4
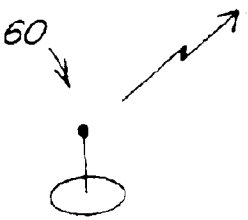

DEEP DEPRESSION ANGLE CALIBRATION OF AIRBORNE DIRECTION FINDING ARRAYS

FIELD OF INVENTION

This invention relates to direction finding and more particularly to a system for calibrating an array of direction finding antennas on an aircraft.

BACKGROUND OF THE INVENTION

Typically and for many years, surveillance aircraft have been provided with an array of for instance sixteen to thirty-two loop and or monopole-type antennas dispersed about the surface of the aircraft to be able to get the bearing line from this aircraft to a source of electromagnetic radiation. This source can be from for instance transmitters used by enemy troops, transmission sources associated with weapons and ordinance, or can be radiation from any type of communications device.

In the past, surveillance aircraft with such an array of direction finding antennas have been calibrated by establishing a calibration antenna on the ground and flying at some distance from this antenna so that the depression angle between the aircraft and the antenna is close to 0°. By depression angle is meant the angle down from the horizontal of a bearing line between the plane and a radiation source on the ground. The calibration of the antenna array involved the flying of an aircraft in a horizontal circular or banana pattern such that the aircraft was in essence turned 360° in azimuth, with measurements made of the response of the antennas at 1° or 20° azimuth increments and for all of the frequencies of interest. This provided a data set so that actual measurements from the aircraft could be correlated with the calibrated data set in order to arrive at a precise bearing line from the source of the electromagnetic radiation to the aircraft. In one example, the desired accuracy was 5°.

As was usually the case, these surveillance aircraft operated a fairly large distance away from enemy territory for safety reasons. Thus, the signals coming from enemy radios or transmitters would come in at a relatively shallow depression angle.

However, with the use of unmanned aerial vehicles, or UAV'S, due to the fact that they are unmanned, they can be flown directly over enemy territory unlike the manned surveillance aircraft used previously. The reason for using unmanned aircraft is to limit the exposure of airmen to hostile fire. However, the use of such UAV's requires that the antenna arrays on the UAV's be calibrated for all depression angles including the relatively deep depression 80°–90° angles that exist as the UAV flies directly over a surveilled area.

The problem of utilizing a full-scale airplane and flying it over a calibrating antenna is that it is very difficult for a plane to maintain a constant depression angle relative to the calibrating antenna when flying the aircraft in a circle. The reason is that it is not possible to spin the aircraft 360° on its own axes above the ground in order to get calibration data for all azimuths. Rather the plane can only execute a relatively large circle or oval. If the plane is close to the calibration antenna, the depression angle at the nearest point on the circle varies greatly from the depression angle at the far point of the circle. Thus, it is exceeding difficult to maintain a constant depression angle for a 360° azimuth sweep when flying a full-scale aircraft. This is due to the dynamics of flight which prohibit tight turns.

In short, when trying to calibrate a DF antenna array at a constant deep depression angle, one cannot do it by flying a plane.

SUMMARY OF THE INVENTION

Noting that there is a difficulty of rotating an aircraft 360° while maintaining a predetermined depression angle for calibration purposes, in the subject invention, an electrically similar scale model of the aircraft is provided with antennas at the same positions as they are on the full-scale aircraft. An optimization technique adjusts the response of the antennas on the model to the expected outputs of the antennas on the full-scale platform. This scale model is located on, the ground at a calibration range and is supported by a gantry which rotates the model over a number of depression angles and also swings the model over the full 360° azimuth range that is required. Measurements are then taken from the model at a wide variety of depression angles, one of which is identical to the shallow depression angle of the full-scale aircraft executing maneuvers at a distance from the calibration antenna. The depression angle measurements from the full-scale aircraft are made at quite some distance from the calibration antenna so that, for instance, a nearly constant depression angle in the range of −2° to −5° can be obtained. The plane is flown in a pattern that will establish the response of the antennas in a 360° azmuth sweep for 1° increments and for all of the frequencies of interest. This provides a data set for the full-scale platform and the particular antenna array, which is then used as a base line to be able to correlate the results of the model with the full-scale aircraft.

Data collected from the model at this shallow depression angle for the indicated frequencies, and at 1° azimuth increments when processed with live data from the aircraft at this shallow depression angle results in a set of complex weights which are used to account for differences between the full-scale and model antenna responses.

Once having model data for this shallow depression angle, data is then taken from them model at the other desired depression angles. This data is corrected by the weights derived from the model and the full-scale aircraft at the above-mentioned shallow depression angle. It is thus a finding of the subject invention that weights generated for the single shallow depression angle done in this fashion can be used to adjust and correct the model airborne array data recorded for all depression angles.

The model therefore provides virtually all of the data that is to be used in the full-scale aircraft. The result is that the full-scale aircraft will be provided with a data set or array manifold that permits accurate direction finding when the aircraft is flying at stand off or stand-in ranges from electromagnetic sources.

Thus, in the present invention, live data need only be taken at one depression angle, which data is then compared with data at a number of different depression angles taken from the model. With the advent of airborne vehicles that fly directly over hostile territory for detecting the direction of RF sources, a method for calibrating the antennas on the vehicles is provided so as to correctly determine the direction of the source of electromagnetic radiation, especially at deep depression angles associated with such flights. In order to accomplish this, all that is required is to obtain a set of data from a given relatively shallow depression angle in a flight test and then provide a model of the aircraft with antennas appropriately located. A weighting system is then devised to be able to weight the outputs of the various antennas on the model such that a data set or array manifold is available at the aircraft to correct the output of the airborne antenna array. When a direction finding algorithm is applied, the accuracy of the direction finding result will be within specified accuracy requirements.

Note that a complex optimization technique is used to generate complex weights that are then used to adjust the data collected from the model to account for the differences between the full-scale and the model antennas arrays. The result is an easily obtained deep depression calibration database.

In summary, a system for calibrating airborne direction finding antenna arrays eliminates the problem of trying to maintain a constant depression angle when flying an airplane directly over a calibration source antenna to collect deep depression angle data. The deep depression angle data necessary for calibration is provided by data from a scale model of the aircraft having a direction-finding array which simulates the actual direction-finding array on the aircraft. In order to collect deep depression angle data, the model is pivoted through 360° while maintaining a controlled depression angle. Thus, it is unnecessary for calibration to actually fly a plane to attempt to obtain deep depression angle measurements. In the subject system, only a very small set of data is required from the aircraft. Thus, with the exception of some baseline shallow elevation angle data from this plane, the calibration data comes strictly from the scale model which is much more easily obtained. Optimization techniques are used in which a set of data is collected from the airplane at one shallow depression angle which is used with the data collected from the scale model at this shallow depression angle to derive a complex set of optimized weights that are then applied to the data collected from the model at the remainder of the depression angles to obtain the appropriate database for use on this aircraft for direction finding. In so doing, the aircraft need only be flown to establish data at a relatively shallow depression angle which can be easily collected by an aircraft flying in circles at some distance from the calibration source.

BRIEF DESCRIPTION OF THE DRAWINGS

These and other features of the drawings of the subject invention will be better understood in connection with the Detailed Description of the Drawings, of which:

FIG. 4 is a diammagratic illustration of a model of the aircraft of FIGS. 1, 2 and 3 which is supported on a positioning system adjacent to a calibration antenna which allows for precise depression angle control; and, FIG. 5 is block diagram of the subject system for the deep depression angle calibration process.

DETAILED DESCRIPTION

The difficulty in maintaining full-scale platform profiles that produce constant and accurate depression angle calibration data for a direction finding array manifold arises from the fact that as the depression angle increases, it is virtually impossible to maintain a constant depression angle for all required azimuth angles.

Figure 1:
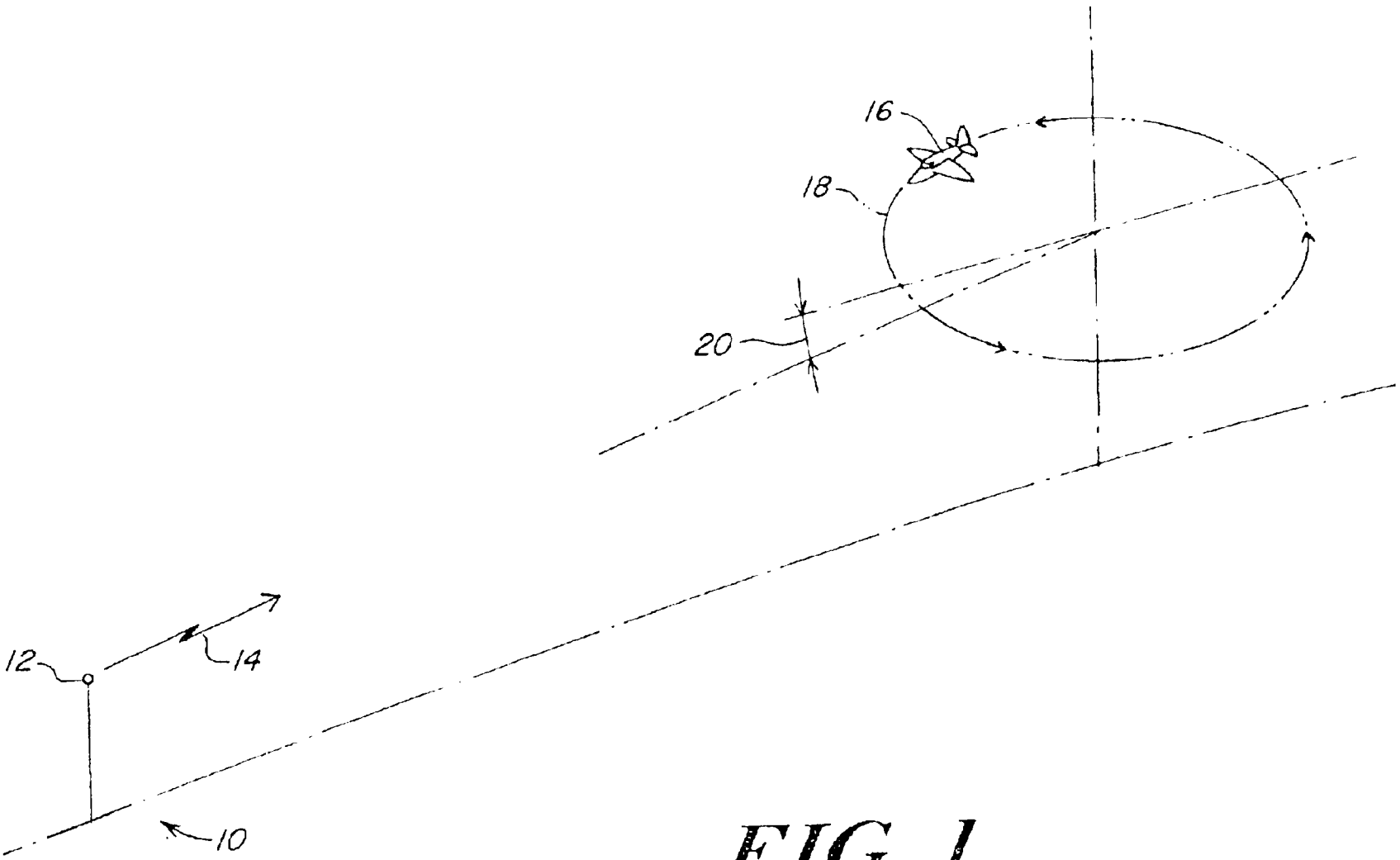
FIG. 1 is a diammagratic representation of an in-flight calibration process in which data is taken through the use of a transmitting antenna at a calibration site which is removed from an aircraft that is being flown in circular orbits to obtain calibration data for the array of antennas on the aircraft.

To see how this is a problem and referring now to FIG. 1, assuming a calibration site 10 having a calibrating antenna 12 radiating as illustrated at 14 towards an aircraft 16 at some distance from the antenna, then when the aircraft if flown in a circular pattern as illustrated at 18 in a normal in-flight calibration process, data is collected over 360° azimuth angles for a depression angle 20 which is kept to a minimum because the aircraft is flown in a pattern which is at some distance from antenna 12. The farther the aircraft is from the antenna, the more closely the depression angle will be to 0°.

This array data collected on the aircraft is used to generate an array manifold (database) for accurate direction finding.

In this manner, the different antennas on the aircraft are characterized for their physical position and their electrical characteristics including scattering from various parts of the aircraft so that when on a surveillance mission the direction of sources of electromagnetic radiation could be ascertained with a fairly high degree of accuracy.

These surveillance aircraft are usually at some distance from potential enemy area or zone to be surveilled such that the depression angle of the line between the source and the aircraft was virtually horizontal, meaning that the depression angle was close to zero. When the antenna arrays were compensated in this manner relatively accurate direction finding bearing angles could be ascertained.

Figure 2:
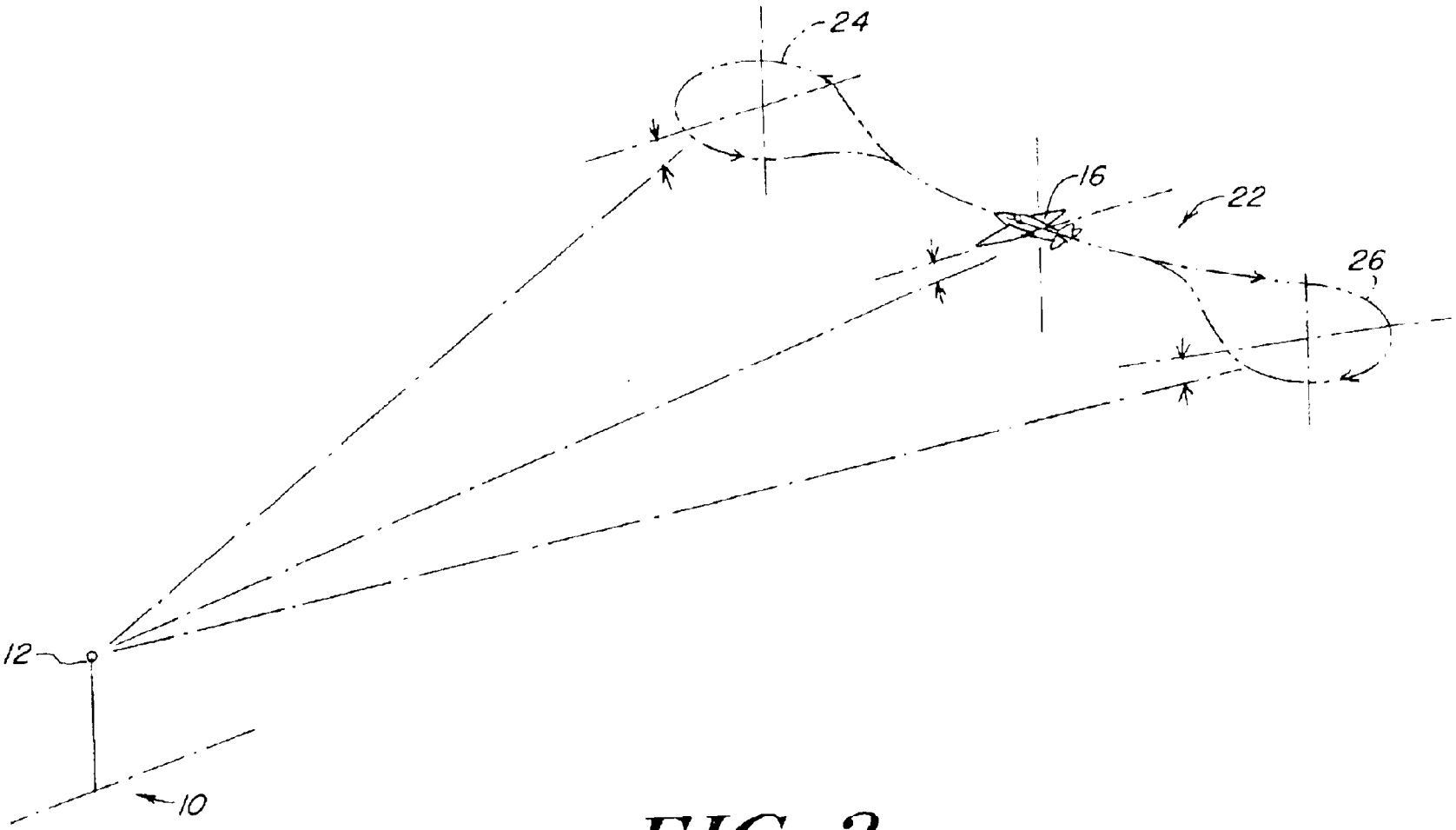
FIG. 2 is a diammagratic representation of a banana pattern of flight of an aircraft with respect to a calibration site-transmitting antenna.

Referring now to FIG. 2, it will be noted that while in FIG. 1 for calibration purposes it is desirable to fly the plane in a circular pattern, it is very difficult from an aerodynamic point of view to control the orientation of the aircraft vis-à-vis the local horizontal, especially if the aircraft is flying a relatively tight circle. As can be seen in FIG. 2, a banana pattern 22 is the preferred method of providing calibration data for an aircraft in which the 360° azimuth angle data points are obtained at either end 24 and 26 of the pattern.

In either case, depression angle changes over the pattern are fairly minimal due to the distance of the aircraft from antenna 12.

Figure 3:
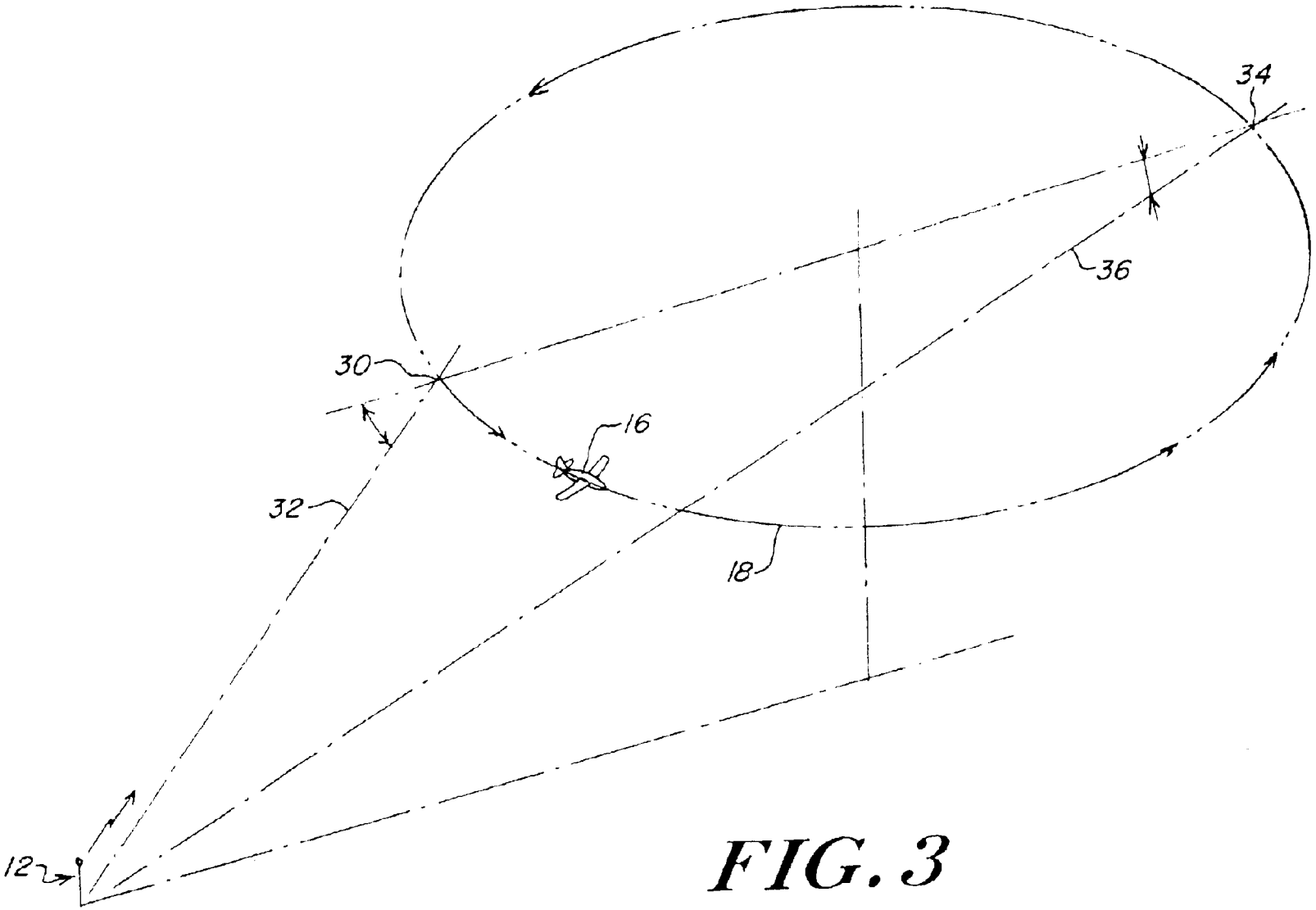
FIG. 3 is a diammagratic illustration of the difficulty of maintaining a constant depression angle when flying a circular pattern showing the difference in depression angle for a point on the circular pattern closest to the antenna, as opposed to a point on the pattern furthest from the antenna.

Referring now to FIG. 3, assuming aircraft 16 is flying a circular pattern 18 with respect to antenna 12, but further assuming that the aircraft rather than being far away is quite close to antenna 12 simulating deep depression angles, then as will be seen a point 30 at a near portion of the circular pattern has a depression angle indicated by bearing line 32, whereas a point 34 at the far end of circular pattern has a bearing angle as illustrated by 36.

As can been seen there is a dramatic difference in depression angles at points 30 and 34 during this flight scenario. The result is that it is virtually impossible to calibrate direction finding arrays for deep depression angles using the in-flight calibration techniques described in FIGS. 1, 2 and 3.

The problem of calibrating for deep depression angles is solved in the subject system by collecting data primarily from a scale model of the aircraft which can be rotated so as to present highly controllable depression angles. The model can be rotated in azimuth while at the same time presenting to the source different aspects of the aircraft corresponding to differing and controllable depression angles for all of the azimuth angles required for calibration. Here the aircraft model is illustrated at 40 supported on a gimbaled gantry generally indicated at 42, with the model having an array of individual antennas 44 placed on the model in exactly the same position are they are in the full-scale platform for which the antenna array is to be calibrated. The model can be rotated as can be shown by double-arrows 50, 52 and 54 so as to provide an aspect to source 60 which yields the requisite data at all azimuth angles required and at all depression angles.

As will be seen the model calibration technique of FIG. 4 allows precise depression angle control. The collected from the data model is multiplied by a series of complex weights so that the calibration data corresponds to the data that would have been the result of rotating the full size aircraft in a manner that is not physically possible aerodynamically.

In order to generate the appropriate set of complex weights, the live data from the airborne platform must provide at least data for one shallow depression angle from the in-flight calibration process. The result is compared to an identical test on the model and the differences are used to generate the complex weights for this one shallow depression angle.

More particularly, subject calibration technique involves collecting calibration data on the full-scale airborne platform at a depression angle that is near to 0°. At this point, a flight profile is developed that will hold the depression angle within reasonable limits on the order of +/−1°. The second step of the process is to collect data from a model in a controlled environment such as a model range. Data is collected at all calibration frequencies for not only the 0° depression angle case but also for all other depression angles required. Using the optimization technique, one takes the 0° depression angle data from the full-scale platform, the 0° depression angle data from the model or mock-up of that platform at the range, calculates the complex optimization coefficient or weights and then applies these weights to the data collected from the model at the depression angles from zero on down through somewhere near 90°. The result is a set of calibration data that has been adjusted with the optimization technique for all depression angles for all frequencies and for all azimuth angles. This data is thus the array manifold or database used by the aircraft to permit accurate direction finding.

Thus, the airborne platform calibration data is collected at a single depression angle near 0°. Complex optimization coefficients are then computed to account for small differences between the full-scale antenna measurements and the model measurements. The model data is then adjusted by applying the complex coefficients, with the results being a full complement of calibration data derived mainly from model measurements resulting in an accurate and complete DF array manifold or dataset for use by the particular aircraft.

How the calibration weights are derived is described in a white paper entitled, "Shipboard Sky Wave Calibration Data Optimization" which technique is used for airborne applications as well. This white paper is now presented:

INTRODUCTION

Accurate shipboard dual polarization, ($E_0$, $E_\Phi$,) calibration, (array manifold steering vector) databases are key to accurate shipboard sky wave DF. Ship model antenna range measurements are the only practical accurate way of obtaining these databases. Methods of moments electromagnetic code have been tried, but our numerical experiments on much simpler electromagnetic problems have shown errors that are several times larger than the (1 dB, 5 degree) requirement. Careful ship model measurements can approach the required accuracy, but it is difficult to accurately model the response of the deck-edge antennas since these antennas are small and have active amplifiers connected to multiple switched turn loops wrapped around small rectangular ferrite bars. Aircore loops must, however, used to model these deck edge antennas, since a 1:48 scale model of a shipboard antenna would be impractical to build. This paper describes an algorithm and presents theoretical data that shows how numerically computed weights compensates for the response differences between two different sets of antenna voltages. Weights are computed using correlation maximization which is the objective function used by all Correlation Interferometer Direction Finding CIDF, algorithms. The MATLAB script program Caloptz.m that performs this maximization process is added as an attachment.

APPROACH

Modeled aircore loops receive the fields over a different scaled volume than the shipboard antennas and have significantly different effective height values. This volume is still electrically small at scaled HF frequencies so that in itself would not cause significant modeling errors. The larger volume of these aircore loops, however, makes it impossible to install these antennas in locations that have the correct relative voltage receptions. The installed complex effective height response is dependent on the position of the loop relative to the deck edge, stanchions, passageways and other shipboard artifacts. To the first order, the response differences between deck edge antennas and scale model loops will not be wave arrival angle dependent, but will be different at each particular antenna site. A single complex weighting factor for each calibration frequency and for each site is used compensate for deck edge antenna modeling induced errors. The effective height difference between modeled and deck edge antennas is determined by comparing the ship's full-scale surface wave calibration data to the modeled surface wave data.

Effective height $h_e$ is defined here by:

$$\text{Voltage}(V_{50})\text{across } 50\ ohms = h_e \cdot 377\ ohms \cdot \text{total magnetic field}(H_1) \quad (1)$$

Equation 1 simply describes the obvious; the received voltage is linearly dependent on both the magnetic field and the effective height($h_e$). Modeling error correction weights are described by the, $W_r$(ifreq,iant). Note: ifreq indicates a calibration frequency index, iant indicates an antenna site.

Optimized Wr(ifreq,iant) should be approximately the same for surface wave signals and sky wave signals and almost exactly true for low elevation angle vertically polarized signals. The compensation approach described herein computes correction weights based on surface wave signals and assumes that this equality holds for all sky wave signals.

Since all surface wave data is vertically polarized let:

$V_f$(ifreq,iant,iaz) refer to shipboard recorded HF data at: frequency/antenna site/surface wave azimuth angle=ifreq/iant/iaz $V_m$(ifreq,iant,iaz) refer to ship model recorded data at: equivalent scaled frequency/antenna site/surface wave azimuth angle=ifreq/iant/iaz Ideally the correction weights would, over all azimuth angles($0 \leqq iaz \leqq 360$), establish the approximate equality:

$$W_r(infreq,iant) \cdot V_m(infreq,iant,iaz) \approx V_f(ifreq,iant,iaz) \quad (2)$$

Equation 2 describes a correction method, but phase measurement reference problems keep it from being implemented in any practical way. Model measurements are made relative to the reference angle of a network analyzer after transiting a lot of cable and the free space length of the antenna range. Measurements on the ship include operational receivers etc and in many cases the reference antenna is a 35' HF whip. Difference in phase references causes problems for solutions based on equation 2, but the problem disappears if we use a correlation process like CIDF that only maximizes over the absolute value of the correlation equation. This eliminates any effects due to a constant phase difference across all complex values. The relevant correlation equation for this process, at a particular azimuth=iaz, is:

$$|R(iaz)|^2 = \frac{\left|\sum_{kl}^{ku} W_r(iant) * V_m(iant, iaz) * V_f^c(inat, iaz)\right|^2}{\sum_{kl}^{ku} |W_r(iant) * V_m(iant, iaz|^2 * \sum_{kl}^{ku} |V_f^c(iant, iaz)|^2} \tag{3}$$

Equation 3 describes the correlation squared value computed for a particular set of weights($W_r$), at azimuth angle iaz, using the antenna set kl≦iant≦ku. Calibration data is not optimized over frequency; therefore the correlation described by equation 3 is computed at a particular frequency ifreq. This index is assumed in the equation 3 and all following analysis. $(\ )^c$ is the refers to the conjugate.

Ship model calibration data optimization is the process of computing the weights $W_r$ that maximize the surface wave correlations (equation 3) for a particular set of antennas. Simultaneous optimization over the set of antennas used for DF seems logical, a set that is designated here by index na. If we assume that the array size is 16 antennas, then the optimization must solve for 16 complex weights. If a single azimuth angle is used in this optimization process, then the result is a single equation having 16 unknowns, which obviously cannot be solved to yield a unique solution. In general, calibration data optimization should include more equations, i.e. azimuth angles in the correlation process than the number DF antennas. The relevant question is: what is the best way to modify equation 3 so that the number of unknowns does not exceed the number of knowns.

An obvious method is to establish an equation that has sum of correlations given by:

$$|R_{total}|^2 = |R(iazl)|^2 + |R(iaz2)|^2 + |R(iaz3)|^2 + \tag{4}$$

and then to maximize this sum over the weights. Each correlation in equation 4 is the ratio of quadratic forms that must be independently maximized. Another solution, the one recommended here is to modify equation 4 and make it into one large single correlation equation. This resultant has the form:

$$|R_{total}|^2 = \frac{|R_{num}(iazl)|^2 + |R(iaz2)_{num}|^2 + |R(iaz3)_{num}|^2 + \ldots}{|R_{den}(iazl)|^2 + |R_{den}(iaz2)|^2 + |R_{den}(iaz3)|^2 + \ldots} \tag{5}$$

Equation 5 is single equation that is the ratio of quadratic forms that can be maximized in closed form over the weights. Each independent denominator term in equation (5) can be simplified if we independently normalize the full-scale ship data at each azimuth point. This normalization sets:

$$\sum_{l}^{na} |V_f^T(iant, iaz)|^2 = 1.0 \tag{6}$$

Each denominator term in equation 5 is then:

$$|R_{den}(iazk)|^2 = \sum_{l}^{na} |W_r(iant) * V_m(iant, iazk)|^2 \tag{7}$$

And each numerator term in equation 5 is:

$$|R_{num}(iazk)|^2 = \left|\sum_{l}^{na} W_r(iant) * V_m(iant, iazk) * V_f^c(iant, iazk)\right|^2 \tag{8}$$

The number of terms in equation 8 goes as the square of the number of antennas, for 16 antennas this number is equal to 256. As azimuth values are summed, the terms having common weight products are added. Partial sums for the ith and jth antenna indices at azimuths iazk and iazl have terms given by:

$$w_r(t)\cdot w_r^c(j)\{v_m(i,iazk)\cdot V_f^c(j,iazk)\cdot v_m^c(i,iazk)\cdot v_f(j,iazk) + v_m(i,iazl)\cdot V_f^c(j,iazl)\cdot v_m^c(i,iazl)\cdot v_f(j,iazl)\} \tag{9}$$

Summation forms, such as that described in equation 9, set up the ratio of quadratic forms. Maximization over all of these weights involves many complex weight products. The solution key can be found by formulating this ratio in a form developed for adaptive array analysis. The relevant techniques are described below.

Array copy signal-noise-ratios (SNRS) are readily computed if the internals; Rss (the signal covariance matrices), Rnn (the noise covariance matrices) are known and W the beam forming weights are specified. The result is the ratio given by:

$$SNR = \frac{W^T R_{ss} W}{W^T R_{nn} W} \tag{10}$$

Equation 10 is a ratio of quadratic forms, which takes on a maximum value for a particular set of weights. For these weights, this maximum is the maximum eigenvalue of the well-known product[1]:

$$(R_{nn})^{-1} \cdot R_{ss} \tag{11}$$

Let this maximum eigenvalue be equal to $\lambda_{max}$. The (W) weights that will generate this maximum are given by the eigenvector associated with zero eigenvalue of:

$$[R_{ss} - \lambda_{max} R_{nn}][W] = 0. \tag{12}$$

The closed form maximization of equation 5 can be accomplished if it can be written in a $$R_{ss} \sum^{iaz(total)} V_m(1:na, iaz) * V_f^c(1:na, iaz)(V_m(1:na, iaz) * V_f^c(1:na, iaz))^T$$

matrix form similar to equation 10. A little algebra shows that equation 5 can be put into this form. The Rss matrix is given by the sum of outer products: $(\ )^T$ refers to the conjugate transpose. The $R_{nn}$ matrix is diagonal with terms given by:

$$R_{nn}(j, j) = \sum^{iaz(total)} |V_m(j, iaz)|^2 \quad (13)$$

NUMERICAL EXPERIMENTS

MATLAB program caloptz.m shows the operation of this algorithm. This program closely follows the theoretical optimization process and terminology described in equations 5–14. Theoretical voltages generated by the ESP methods of moments were used as inputs. These theoretical voltages were generated across the terminals of the slanted loops were spaced off a set of octagonal plates. $E_0$ the vertically polarized set was used in these numerical experiments. This array has complete 8-way symmetry, therefore, seven 45 degree offsets of the single full 360 degree pattern, listed in espot.dat, was used to generate the required 7 antenna additional complex patterns. These voltages are identified Verf(iant,iaz) which would correspond to the accurate full scale shipboard calibration data. This one wavelength diameter octagonal array has previously been used in a number of numerical experiments. Each of the eight antenna voltages were modified by a multiplication by eight different complex error weights; Wcer(iant,1) which results in voltages that would represent model measurements Verm(iant,iaz) that include errors. Wcer(iant,1) error coefficients are generated with the aid of a multiplication term= ampu. All Wcer(:,1) terms are equal to unity when ampu is set to zero. Noise at a chosen SNRdB level is added to the synthetic model data to make the computations more realistic. The test is: does the optimization program correct for the errors induced into the model data, and how many azimuth optimization angles need to be included in the optimization program?

Numerous interesting experiments can be conducted with the caloptz.m. This program shows large correlation improvements. Without noise, the corrections are perfect. These correlation increases from an SNR of 60 dB to 20 dB were achieved with an azimuth optimization set of 15 angles. An interesting effect was noted that optimization could be achieved with smaller azimuth optimization sets than the number of antennas.

REFERENCES

[1] R. A Monzingo and T. W. Miller, Introduction to Adaptive Arrays, Wiley, N.Y., 1980. pp 90–97.

Figure 5:
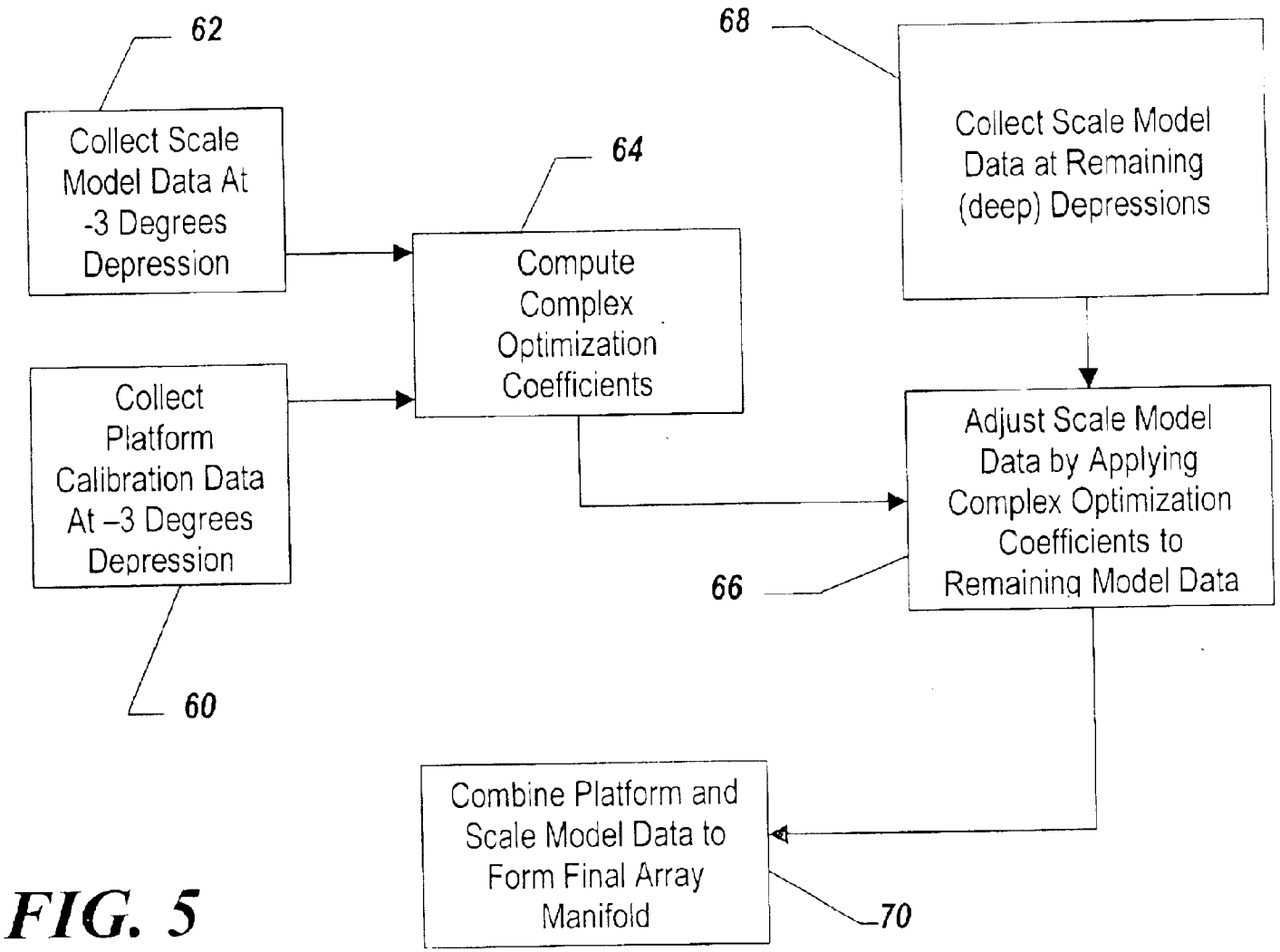

Referring now to FIG. 5, a process flowchart is described for a deep depression angle calibration process using −3° as the baseline depression angle.

Here it can be seen at 60 that data is collected from the airborne platform at a −3° depression angle, whereas data is collected from the scale model as illustrated at 62, again at this −3° depression angle. This collected data is provided to a computer 64 which computes the complex optimization coefficients which are then applied to adjust the scale model data by applying the complex optimization co-efficients to the remaining model data as illustrated at 66. In order to do this, data collected from the scale model at the remaining deep depression angles is provided at 68.

Finally, as illustrated at 70, the data from the flying platform is combined with the scale model data to form a final array manifold or database set.

The result of utilizing the optimized scale model data to form an array manifold are first and foremost an accurate spatial azimuth and depression angle positioning can be easily achieved. Moreover, because of the use of the model, one can maintain high signal to noise ratios without interfering signals in which the polarization purity is easily achieved while at the same time significantly reducing platform flight hours. Also, the calibration technique is not severely constrained by downtime due to poor weather conditions.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. In the system for calibrating an antenna array on an aircraft used for direction finding by flying the aircraft relative to a calibration antenna, a method for calibrating the array for deep depression angles comprising the steps of:

providing a scale model of the aircraft with an antenna array having antennas located at the same positions as on the aircraft;

locating the scale model in a range at a distance from a calibrating antenna;

collecting data from the scale model at various calibration frequencies, azimuths and depression angles relative to the calibrating antenna to provide model-derived data;

flying the aircraft at a distance from the calibrating antenna so as to collect baseline data at a predetermined shallow depression angle, and, combining the baseline data at the shallow depression angle with model-derived data at both the shallow depression angle and other depression angles to create an array manifold for compensating output of the antenna array on the aircraft, whereby accurate direction finding can be achieved when the aircraft files directly over a source of electromagnetic radiation.

2. The method of claim 1, wherein aircraft collected data is collected at only one depression angle.

3. The method of claim 1, wherein the antenna manifold includes a set of complex weights used for correcting the output of the airborne array.

4. The method of claim 3, wherein the set of complex weights includes weights based on the shallow depression angle aircraft-derived data, and a set of weights based on the scale model-derived data, and wherein the last-mentioned sets of weights are compared, with the differences between the two sets being used to create the complete array manifold.

5. A method for minimizing the standoff distance that an aircraft having an airborne antenna direction finding array with a number of antennas at different positions on the aircraft must maintain relative to a source of electromagnetic radiation in order to achieve acceptable direction finding results, comprising the steps of:

calibrating the airborne antenna array for deep depression angles by providing a scale model of the aircraft with an antenna array having antennas located at the same positions as on the aircraft; locating the scale model in a range at a distance from a calibrating antenna; collecting data from the scale model at various calibration frequencies, azimuths and depression angles relative to the calibrating antenna to provide model-derived data; flying the aircraft at a distance from the calibrating antenna so as to collect baseline data at a predetermined shallow depression angle, and combining the baseline data at the shallow depression angle with model-derived data at both the shallow depression angle and other depression angles to create an array manifold for compensating output of the antenna array on the aircraft, whereby accurate direction finding can be achieved when the aircraft files directly over a source of electromagnetic radiation.

* * * * *